US009898898B2

(12) United States Patent
Brewer et al.

(10) Patent No.: US 9,898,898 B2
(45) Date of Patent: Feb. 20, 2018

(54) VARIABLE STRIP FOR MECHANICAL REEL GAMING DEVICE

(71) Applicant: IGT, Las Vegas, NV (US)

(72) Inventors: James Brewer, Sparks, NV (US); Gene A. Spoor, Sparks, NV (US)

(73) Assignee: IGT, Las Vegas, NV (US)

( * ) Notice: Subject to any disclaimer, the term of this patent is extended or adjusted under 35 U.S.C. 154(b) by 1026 days.

(21) Appl. No.: 14/089,544

(22) Filed: Nov. 25, 2013

(65) Prior Publication Data

US 2015/0087384 A1 Mar. 26, 2015

Related U.S. Application Data

(60) Provisional application No. 61/880,718, filed on Sep. 20, 2013.

(51) Int. Cl.
*G07F 17/34* (2006.01)
*G07F 17/32* (2006.01)

(52) U.S. Cl.
CPC ..... *G07F 17/34* (2013.01); *G07F 17/3202* (2013.01); *G07F 17/3213* (2013.01)

(58) Field of Classification Search
CPC ..... G07F 17/34; G07F 17/32; G07F 17/3202; G07F 17/3211; G07F 17/3213
See application file for complete search history.

(56) References Cited

U.S. PATENT DOCUMENTS 7,371,171 B1 * 5/2008 Englman ..... G07F 17/3244 273/138.2
8,223,113 B2 7/2012 Kerofsky
8,323,113 B2 12/2012 Kaminkow et al.
2003/0190948 A1 * 10/2003 Baerlocher ..... G07F 17/34 463/20
2003/0195035 A1 * 10/2003 Onuki ..... G07F 17/3202 463/20
2005/0282613 A1 * 12/2005 Pryzby ..... G07F 17/3227 463/20
2013/0310143 A1 * 11/2013 Kondo ..... G07F 17/3213 463/20

FOREIGN PATENT DOCUMENTS

JP 2013-176515 A 9/2013
JP 2013176515 A * 9/2013

* cited by examiner

*Primary Examiner* — Jasson Yoo

(74) *Attorney, Agent, or Firm* — Neal, Gerber & Eisenberg LLP

(57) ABSTRACT

A gaming device includes a cabinet, a display coupled to the cabinet, and a reel assembly positioned within the cabinet. The reel assembly includes a reel configured to rotate, and a reel strip coupled to the reel and including a symbol having a first image and a second image. The gaming device also includes a light source located within the cabinet and configured to selectively project a light for backlighting the reel strip, wherein the light source has a first mode for projecting the light in a first configuration and a second mode for projecting the light in a second configuration, and a game controller coupled to the cabinet and configured to control the light source. The first image is viewable when the light source projects the light in the first configuration to backlight the reel strip, and the second image is viewable when the light source projects the light in the second configuration to backlight the reel strip.

22 Claims, 5 Drawing Sheets

VARIABLE STRIP FOR MECHANICAL REEL GAMING DEVICE

CROSS-REFERENCE TO RELATED APPLICATIONS

The present application claims priority under 35 U.S.C. § 119(e) to U.S. Provisional Patent Application No. 61/880,718, filed on Sep. 20, 2013 and titled "Variable Strip for Mechanical Reel Gaming Device," the entirety of which is incorporated by reference.

BACKGROUND

Slot machines often use revolving mechanical reels to display and determine results. For example, a mechanical reel slot machine may include approximately three to five mechanical reels, with each mechanical reel having approximately fifteen to twenty symbols for a relatively small number of combinations. In order to increase the number of possible combinations, conventional slot machines typically require additional or larger reels, which increase the size of the machine and potentially increases the floor space occupied by the machine. In addition, the number of components within the machine may increase, which may require additional maintenance and service.

SUMMARY

An exemplary embodiment relates to a gaming device. A gaming device includes a cabinet, a display coupled to the cabinet, and a reel assembly positioned within the cabinet. The reel assembly includes a reel configured to rotate, and a reel strip coupled to the reel and including a symbol having a first image and a second image. The gaming device also includes a light source located within the cabinet and configured to selectively project a light for backlighting the reel strip, wherein the light source has a first mode for projecting the light in a first configuration and a second mode for projecting the light in a second configuration. The gaming device further includes a game controller coupled to the cabinet and configured to control the light source. In this embodiment, the first image is viewable when the light source projects the light in the first configuration to backlight the reel strip, and the second image is viewable when the light source projects the light in the second configuration to backlight the reel strip.

Another exemplary embodiment relates to a reel assembly for a gaming device. The reel assembly includes a chassis, a reel coupled to the chassis and configured to rotate relative to the chassis, and a reel strip coupled to the reel and configured to rotate with the reel. The reel strip includes a symbol having a first image and a second image. The reel assembly also includes a light source coupled to the chassis and positioned within the reel strip to backlight the reel strip. The light source has a first mode for projecting the light in a first configuration and a second mode for projecting the light in a second configuration. The first image is viewable when the light source projects the light in the first configuration to backlight the reel strip, and the second image is viewable when the light source projects the light in the second configuration to backlight the reel strip.

Another exemplary embodiment relates to a reel strip for a mechanical reel gaming device. The reel strip includes a flexible laminate for attaching to a slot reel, and a variable portion positioned on the flexible laminate and including a symbol having a first image and a second image. The first image is viewable in response to a light source projecting a light having a first light configuration to backlight the variable portion, and the second image is viewable in response to the light source projecting a light having a second light configuration to backlight the variable portion.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

A mechanical reel gaming device having a variable display is described. The gaming device includes a reel strip or filter that couples to the mechanical reel in order to provide a variable symbol for the gaming device. A light source is configured to backlight the reel strip by projecting a light having a light configuration. For instance, the light configuration may include a light color (e.g., an RGB color model), a light intensity (e.g., a brightness of the light), a light duration, or another factor or characteristic of the projected light. In some embodiments, one or more symbols of the reel strip are modified in response to the particular light configuration of the projected light. The light may include one or more colors such that the symbols or other portions of the reel strip convey the color within the light configuration. The light configuration may be selected based on a particular mode of the gaming device, such as a bonus mode, so that the composition of one or more symbols of the reel strip change when the gaming device is in the bonus mode or is toggled between modes. The gaming device may also include a controller for controlling the light source, including the light configuration of the light projected by the light source to backlight the variable reel strip.

Figure 1:
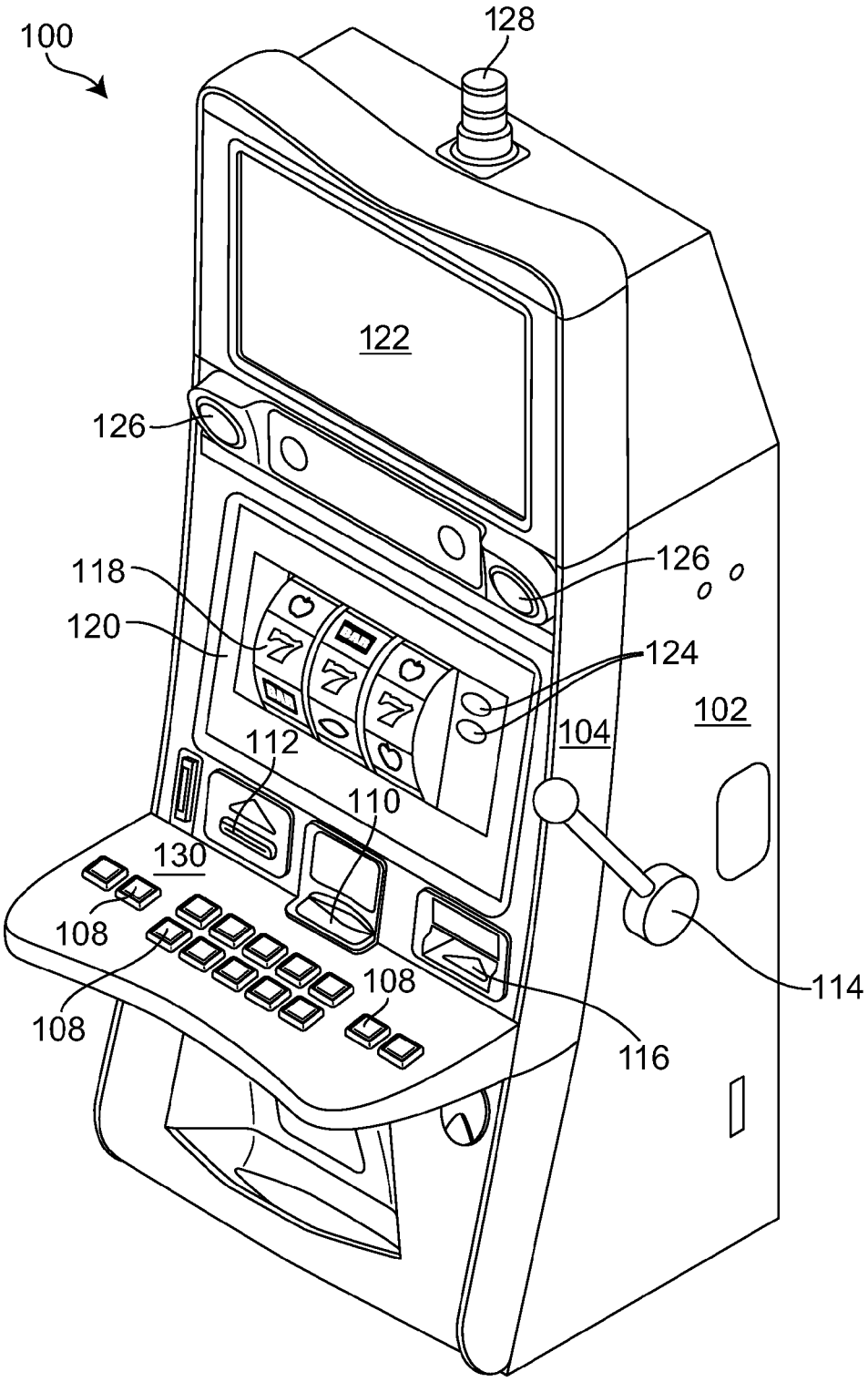
FIG. 1 is an illustration of a gaming device according to an exemplary embodiment.

Referring to FIG. 1, a gaming device 100 is shown according to an exemplary embodiment. In this embodiment, the gaming device 100 includes a main cabinet 102. The main cabinet 102 provides a secure enclosure that prevents tampering with device components, such as a game controller (not shown) located within the interior of the main cabinet 102. The main cabinet 102 includes an access mechanism, such as door 104, which allows the interior of the gaming device 100 to be accessed. Actuation of the door 104 may be controlled by a locking mechanism (not shown) intended to limit access to the interior of the gaming device 100. In some embodiments, the locking mechanism, the door 104, and the interior of the main cabinet 102 may be monitored with security sensors of various types to detect whether the interior has been accessed. For instance, a light sensor may be provided within the main cabinet 102 to detect a change in light-levels when the door 104 is opened and/or an accelerometer may be attached to the door 104 to detect when the door 104 is opened.

The gaming device 100 includes any number of user interface devices that convey sensory information to a user and/or receive input from the user. For example, the gaming device 100 may include an electronic display 122, a display panel 120, speakers 126, an information panel 124, and/or a candle device 128 to convey information to the user of the gaming device 100. A plurality of slot reel assemblies 118 are positioned behind the display panel 120 and viewable through the door 104 (e.g., through the display panel 120). Each of the slot reel assemblies 118 are covered with at least one reel strip such as reel strip 200 shown in FIG. 2 and described in further detail below. The electronic display 122 is located above the door 104. The electronic display 122 may be a cathode ray tube (CRT) monitor, a liquid crystal display (LCD) monitor, or another type of electronic display suitable for the particular application of the gaming device 100. Various embodiments of the gaming device 100 may utilize the electronic display 122 to provide additional features, such as bonus games and/or attract sequences, to a base game being played on gaming device 100.

The gaming device 100 includes a console 130 coupled to the door 104 and having one or more inputs 108 (e.g., buttons, track pads, etc.) configured to receive input from a user. A controller (e.g., game controller 600 shown in FIG. 6) within the gaming device 100 may run a game, such as a wager-based game, in response to receiving input from a user via the inputs 108 or the display 122. For example, the inputs 108 may be operated to place a wager in the game and to run the game. The gaming device 100 also includes a slot reel handle 114 that may be pulled by the user of the gaming device 100 to run the game. In response, the controller may activate the slot reel assemblies 118 and/or the electronic display 122 to execute and display results of the game. The information panel 124 positioned adjacent the slot reel assemblies 118 may also display information related to the game play to the user of the gaming device 100. The information panel 124 may be a back-lit glass panel including lettering or other indicia that indicate general game information such as a number of coins or tokens played. During the game, the user may view additional game information and/or be presented with additional game options using the electronic display 122 and/or the information panel 124. The user may be prompted to make a number of decisions that may affect the outcome of the game. The user may input such decisions using the player-input buttons 108. Further, during certain game events, the gaming device 100 may display visual effects and/or emit audible effects that are perceived by the player in order to add excitement to the game. Visual effects may include flashing lights, strobe lights, and/or other visual effects produced or otherwise displayed by lights (not shown) on the gaming device 100. Moreover, visual effects may be displayed via patterns on the electronic display 122 and/or from lights positioned on and/or within the slot reel assemblies 118 (shown in further detail in FIG. 2). Auditory effects may include various sounds that are projected by the speakers 126.

The gaming device 100 may also include devices for conducting a wager-based game. For example, the gaming device 100 may include a ticket acceptor 116 and a printer 110. In various embodiments, the gaming device 100 may be configured to run on credits that may be redeemed for money and/or other forms of prizes. The ticket acceptor 116 may read an inserted ticket having one or more credits usable to play a game on the gaming device 100. For example, a player of the gaming device 100 may wager one or more credits within a slot game. If the player loses, the wagered amount may be deducted from the player's remaining balance on the gaming device 100. However, if the player wins, the player's balance may be increased by the amount won. Any remaining credit balance on the gaming device 100 may be converted into a ticket via the printer 110. For example, a player of the gaming device 100 may cash out of the device 100 by selecting to print a ticket via the printer 110. The ticket may then be used to play other gaming devices or redeemed for cash and/or prizes. According to various embodiments, the gaming device 100 may record data regarding its receipt and/or disbursement of credits. For example, the gaming device 100 may generate accounting data whenever a result of a wager-based game is determined. In some embodiments, the gaming device 100 may provide accounting data to a remote data collection device, allowing the remote monitoring of the gaming device 100.

In one embodiment, the gaming device 100 includes a loyalty card acceptor 112. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming device 100. For example, a user having a loyalty account may be given a bonus turn on the gaming device 100 or credited loyalty points for playing the gaming device 100. Such loyalty points may be exchanged for loyalty rewards (e.g., a free meal, a free hotel stay, a free room upgrade, discounts, etc.).

Figure 2:
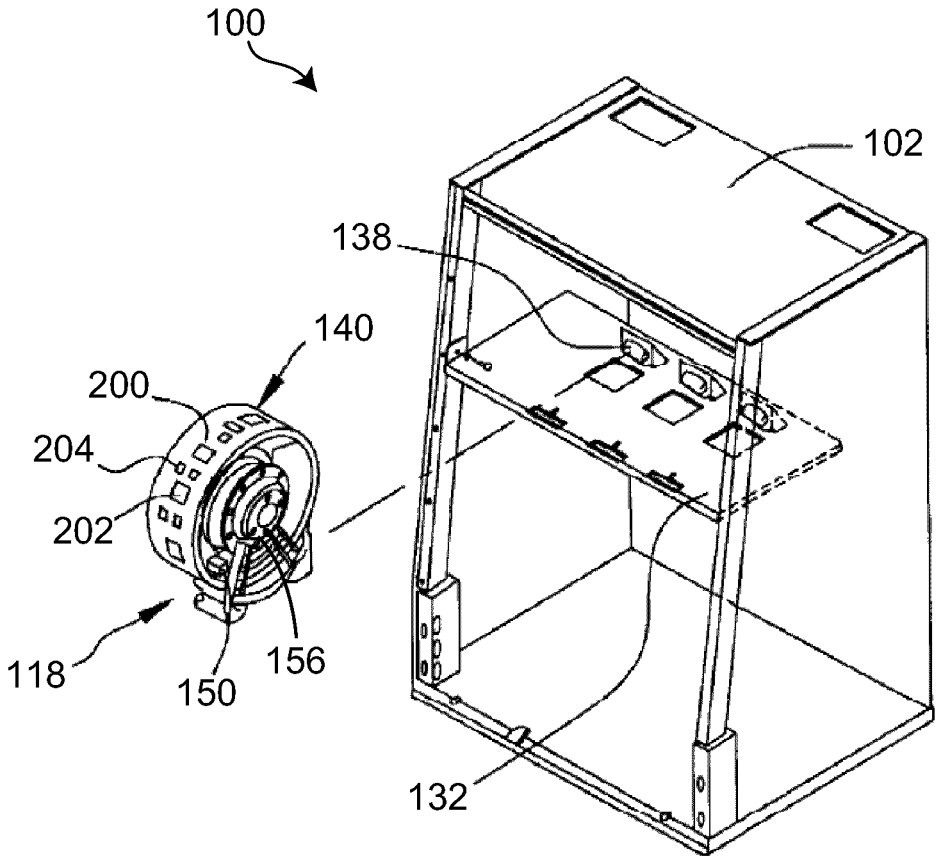
FIG. 2 is a partial exploded view of a main cabinet for the gaming device according to an exemplary embodiment.

Referring now to FIG. 2, a slot reel assembly 118 for the gaming device 100 is shown according to an exemplary embodiment. In this embodiment, a reel shelf 132 is positioned within the main cabinet 102 for supporting multiple slot reel assemblies 118. Mating connectors 138 are positioned on the reel shelf 132. In an exemplary embodiment, each of the slot reel assemblies 118 are coupled to a corresponding mating connector 138, such as to couple the slot reel assemblies 118 to the reel shelf 132. The mating connectors 138 also provide connections to a power supply (not shown) for providing power to the slot reel assemblies 118 and to control circuitry (not shown) for controlling one or more components of the slot reel assemblies 118.

Each of the slot reel assemblies 118 includes a slot reel 140 coupled to a reel chassis 156. The slot reel 140 has a circular or wheel shape and is configured to spin or rotate relative to the reel chassis 156 during game play (e.g., in response to input from the user of the gaming device 100). The slot reel 140 includes a reel strip 200 coupled or applied to the slot reel 140 such that the reel strip 200 spins or rotates with the slot reel 140. The reel strip 200 may be made from a flexible material (e.g., a flexible laminate) in order to match the shape of the slot reel 140. In an exemplary embodiment, the reel strip 200 covers an outer surface of the slot reel 140. In the illustrated embodiment of FIG. 2, the reel strip 200 is sized to wrap substantially around the circumference of the slot reel 140, such that the slot reel 140 includes a single reel strip 200 for covering the slot reel 140. In other embodiments, the reel strip 200 may be otherwise sized or shaped, such that more than one reel strip 200 is required to span an outer surface of the slot reel 140. The reel strip 200 includes a plurality of symbols 202 that are utilized during game play. The symbols 202 are configured to rotate with the slot reel 140 through a display position in which the symbols 202 are viewable by a user of the gaming device 100, with the slot reel 140 ultimately resting so that one of the symbols 202 is within the display position. The reel strip 200 may also include identification patterns 204 and/or marks that each correspond to a particular reel stop (e.g., the display position). The identification patterns 204 may be used to stop or center the slot reel 140 at the particular reel stop, such as to center or align one of the symbols 202 on a betting line or for viewing by a user of the gaming device 100.

The slot reel assembly 118 also includes a light source 150 that emits light (e.g., visible light, infrared light, incandescent light, fluorescent light, etc.). In some embodiments, the light source 150 includes a plurality of light-emitting diodes (LEDs) and is configured to emit or project LED light. In an exemplary embodiment, the light source 150 is positioned in an interior space of the reel strip 200 (e.g., the slot reel 140) and is oriented or otherwise configured to "backlight" the reel strip 200, directing LED light through the reel strip 200 and into the exterior of the reel strip 200. The light source 150 may emit or project light having a particular light configuration. For instance, the light configuration may include a light color (e.g., an RGB color model), a light intensity (e.g., a brightness of the light), a light duration, or another factor or characteristic of the projected light suitable for the particular application of the gaming device 100. The light configuration may be determined or controlled by game controller 600 (shown in FIG. 6) such as in response to an input (e.g., via the inputs 108) from the user of the gaming device 100. In an exemplary embodiment, the light source 150 includes a plurality of individual LED lights that are controllable to form the particular light configuration, such as by the game controller 600. The light source 150 may include other types of light, such as incandescent light, fluorescent light, high-energy discharge light, and/or infrared light. In an exemplary embodiment, the light source 150 does not project ultraviolet light.

Figure 4:
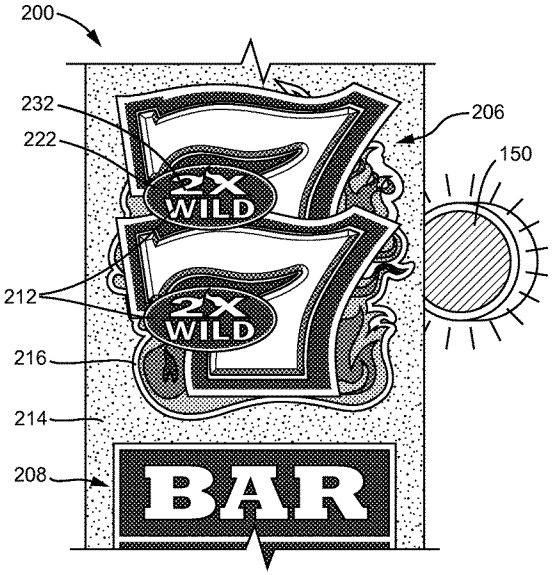
FIG. 4 is a front view of the reel strip receiving a light having a second light configuration from the light source according to an exemplary embodiment.
Figure 3:
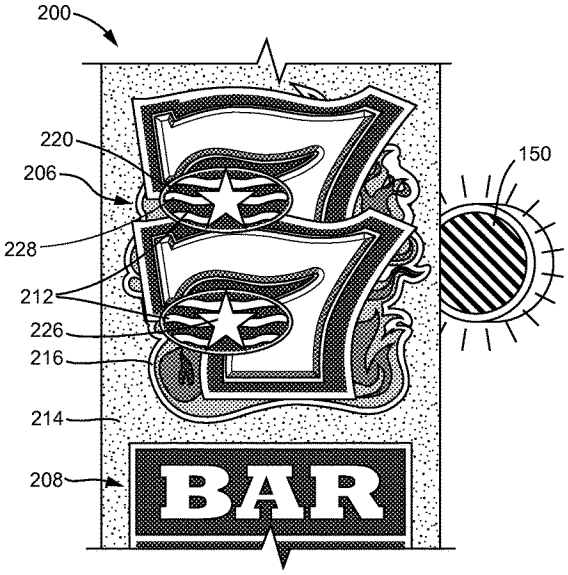
FIG. 3 is a front view of a reel strip receiving a light having a first light configuration from a light source according to an exemplary embodiment.

Referring now to FIGS. 3 and 4, the reel strip 200 is shown according to an exemplary embodiment. In this embodiment, the reel strip 200 includes a laminate or composite material configured to couple or attach to the slot reel 140. The reel strip 200 is shown as a flat strip in FIGS. 3 and 4, but the reel strip 200 may be flexible in order to approximate the shape of the slot reel 140. In an exemplary embodiment, the gaming device 100 includes multiple slot reel assemblies 118 and each assembly 118 includes at least one reel strip 200 having multiple symbols such as symbols 202. During a single game play of the gaming device 100, each of the slot reels 140 may rotate or spin, with at least one of the symbols 202 from each of the slot reels 140 being displayed to the user of the gaming device 100 during and/or at the conclusion of each game play (e.g., via a display position). The pattern of the symbols 202 displayed to the user may determine the outcome of the game play, including the payout to the user.

The reel strip 200 includes a front side 228 for conveying information to a user of the gaming device 100 and a back side (not shown) positioned opposite the front side 228. As described above, the reel strip 200 may include a plurality of symbols 202 that may be displayed to a user (i.e., player) of the gaming device 100 via the front side 228. In the illustrated embodiment of FIGS. 3 and 4, the reel strip 200 is shown to include a first symbol 206 and a second symbol 208. In this embodiment, by way of example, the first symbol 206 includes a "lucky seven" or "7" graphic or image, and the second symbol 208 includes a "BAR" graphic or image. As will be appreciated, the symbols 206 and 208 may include another graphic or image. The back side of the reel strip 200 is configured to attach to the slot reel 140, facing the light source 150 when installed within the gaming device 100 such that the light from the light source 150 is directed through the reel strip 200 and into the exterior of the reel strip 200 to generate one or more images.

In an exemplary embodiment, the first symbol 206 includes a border 216 substantially surrounding the first symbol 206. In the illustrated embodiment, the border 216 is substantially transparent, such that the light projected from the light source 150 passes through the border 216 and may be seen by a user of the gaming device 100. The particular light configuration may change the appearance of the border 216. For instance, when the light configuration includes a blue color, the border 216 may be tinted or colored by the projected light such that the border 216 appears blue to the user. Likewise, when the light configuration includes a red color, the border 216 may appear red to the user. However, the shape or image of the border 216 remains substantially the same regardless of the light projected by the light source 150. In other embodiments, the border 216 may be opaque or have another light-reactive property suitable for the particular application of the reel strip 200 and/or the border 216. The second symbol 208 may also include a border similar to the border 216 and surrounding the second symbol 208. In some embodiments, the reel strip 200 includes a border on at least one side of the reel strip 200 and being similar to the border 216. The reel strip 200 may include other substantially transparent portions, such as borders for separating one or more images or shapes within the symbols 206 and 208. These substantially transparent portions may be similar to the border 216, providing a contrast between two images or shapes within the reel strip 200. The appearance of these substantially transparent portions may also change based on the configuration of the light projected by the light source 150, such as to change color or to blink. However, the shape remains substantially the same regardless of the light configuration in an exemplary embodiment.

In some embodiments, the reel strip 200 includes a base portion 214 surrounding the first symbol 206 and the second symbol 208 (e.g., the border 216 and the border of the second symbol 208). In an exemplary embodiment, the base portion 214 is substantially opaque, such that the light from the light source 150 may not pass through the base portion 214 of the reel strip 200. For instance, the base portion 214 may be a solid color in order to create a contrast between the base portion 214 and the symbols 206 and 208 such that the symbols 206 and 208 are easier to see and differentiate. In other embodiments, varying amounts of light from the light source 150 may pass through the base portion 214, such that the base portion 214 includes a hue that is influenced by the selected light configuration. In one embodiment, the base portion 214 may include a sparkling or bright pattern intended to create excitement for the user of the gaming device 100 and provide the necessary contrast to differentiate the symbols 206 and 208 from the base portion 214. In other embodiments, the base portion 214 may not be opaque, but may have other properties consistent with the purpose of the base portion 214 in the particular application of the reel strip 200. In an exemplary embodiment, the base portion 214 is symmetrical, having a shape on the back side of the reel strip 200 that is substantially a reflection of the shape on the front side 228 shown in FIGS. 3 and 4.

In an exemplary embodiment, the first symbol 206 includes a variable portion 212 configured to convey an image to a user of the gaming device 100. The variable portion 212 includes two or more types of printed ink that are combined into a single image or layer of film and printed onto the reel strip 200 in order to convey two or more images within the variable portion 212. One of the two or more images is viewable by the user depending on the configuration of the light projected through the reel strip 200 by the light source 150. Portions of the variable portion 212 may appear transparent, opaque, and/or having another composition depending on the particular light configuration and the images printed onto the reel strip 200. In an exemplary embodiment, intersections between the two or more images are made white or clear, such that the intersections are not viewed by the user and do not affect the intended image. Transparent portions of the reel strip 200 are intended to allow the light from the light source 150 to pass through these portions in order to affect the color or another characteristic of the transparent portions. Opaque portions of the reel strip 200 are intended to substantially block the light from the light source 150, such as to enhance the image(s) to be conveyed by the reel strip 200.

Referring to FIG. 3, the reel strip 200 is shown according to when the light source 150 is in a first mode. The first mode may be a default mode for the light source 150 and/or the gaming device 100. When the light source 150 is in the first mode, the light source 150 projects a light having a first light configuration to backlight the reel strip 200. When the light having the first light configuration passes through the reel strip 200, a first image 220 is viewable by a user of the gaming device 100 within the variable portion 212 of the first symbol 206. The variable portion 212 includes ink for filtering light from the light source 150, such that the unfiltered portion within the variable portion 212 is viewable to the user and forms the first image 220. In the illustrated embodiment of FIG. 3, the variable portion 212 includes a first ink that filters light from the light source 150 having the first light configuration. The first ink is printed onto the reel strip 200 in a shape such that the unfiltered light passing through the variable portion 212 is viewable by the user as the first image 220. The variable portion 212 may include one or more transparent and/or opaque portions or sections within the variable portion 212, such as one or more designs or compositions. In the illustrated embodiment, the first image 220 includes a design having a star 226 and stripes 228, but the first image 220 may be another image, design, or shape in other embodiments. In this embodiment, the star 226 and the stripes 228 are substantially transparent to the projected light and are configured to allow light having the first light configuration to pass through the variable portion 212, such that the star 226 and the stripes 228 (i.e., the first image 220) are viewable by the user in the first mode of the light source 150 (i.e., in response to the first light configuration). In an exemplary embodiment, the first light configuration includes a blue color (e.g., a color having an RGB color value of 60, 244, 220), causing the star 226 and the stripes 228 of the first image 220 to have a blue color in contrast with the dark and opaque surrounding sections or lines (i.e., the filtering portions) within the variable portion 212 of the first symbol 206. The blue backlighting from the first light configuration also causes the transparent border 216 to have a blue tint in this embodiment, as well as any other transparent portions or sections within the reel strip 200.

Referring to FIG. 4, the reel strip 200 is shown according to when the light source 150 is in a second mode. The second mode may correspond to a second game mode of the gaming device 100, or the second mode may be triggered or utilized as part of the default game mode or first game mode. When the light source 150 is in the second mode, the light source 150 projects a light having a second light configuration to backlight the reel strip 200. In the illustrated embodiment of FIG. 4, the variable portion 212 includes a second ink that filters light from the light source 150 having the second light configuration. The second ink is printed onto the reel strip 200 (e.g., along with the first ink). The second ink has a shape such that the unfiltered light passing through the variable portion 212 is viewable by the user as the second image 222. In the illustrated embodiment, the second image 222 includes text 232 reading "2×WILD" to indicate that the first symbol 206 has an alternative significance or meaning in the context of the game, but the second image 222 may be another image, design, or shape in other embodiments. In this embodiment, the text 232 is substantially transparent to the projected light and is configured to allow light having the second light configuration to pass through the variable portion 212, such that the text 232 (i.e., the second image 222) is viewable by the user in the second mode of the light source 150 (i.e., in response to the second light configuration). The star 226 and the stripes 228 of the first image 220 (shown in FIG. 3) are substantially opaque to the projected light having the second light configuration (i.e., the projected light is filtered by the star 226 and the stripes 228). In an exemplary embodiment, the second light configuration includes a red color (e.g., a color having an RGB color value of 255, 54, 43), causing the text 232 of the second image 222 to have a red color in contrast with the dark and opaque surrounding sections or lines (i.e., the filtering portions) within the variable portion 212 of the first symbol 206. The red backlighting from the second light configuration also causes the transparent border 216 to have a red tint in this embodiment, as well as any other transparent portions or sections within the reel strip 200.

In an exemplary embodiment, a patterned laminate (not shown) or similar material is applied to the back of the reel strip 200 (i.e., the side facing the light source 150). In this embodiment, the patterned laminate is intended to diffuse the hard lines between the symbols 206 and 208, the border 216, and/or any other patterns or designs of the reel strip 200, such as those having contrasting light-reactive properties. When the light source 150 projects a light to backlight the reel strip 200, a glitter pattern or another similar transitional pattern is produced between two portions of the reel strip 200 by the combination of the light and the patterned laminate. In an exemplary embodiment, the patterned laminate is attached to the back side of the strip 200 by a permanent adhesive. The patterned laminate may cover at least the first symbol 206, and in some embodiments covers the entire back side of the reel strip 200 in order to differentiate between the symbols 206 and 208 and other designs of the reel strip 200.

In one embodiment, the symbol 206 is relatively non-reactive to a light source directed to the front side 228 of the reel strip 200. For instance, the reel strip 200 may include a film that blocks the passage of light through the reel strip 200 from the front side 228 of the reel strip 200 so that the symbol 206 is unchanged in response to a front light. The reel strip 206 may also include a similar film intended to prevent light from reflecting off of the front side 228 of the reel strip 200.

Figure 5:
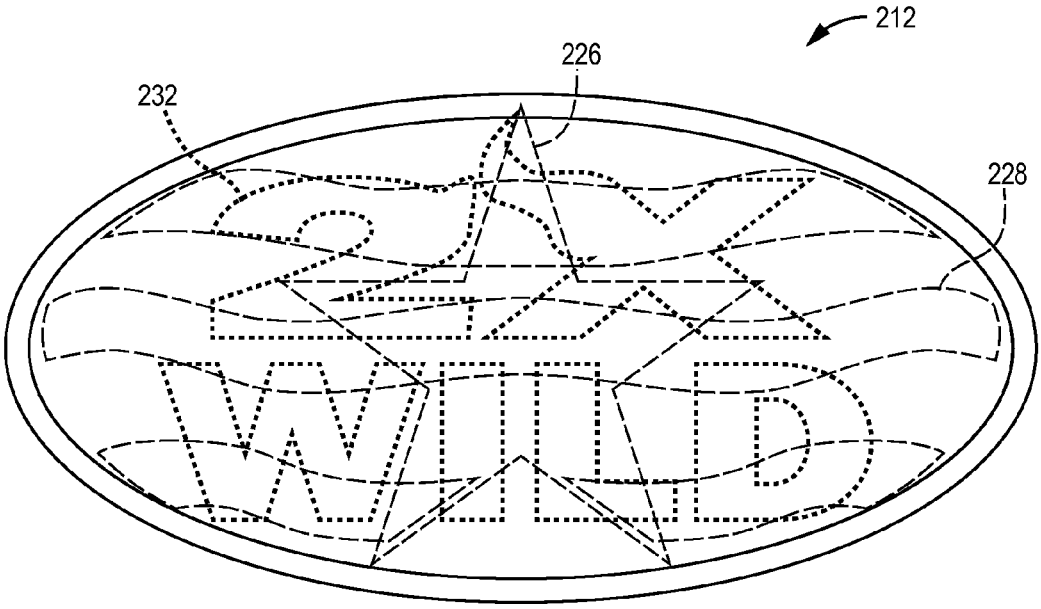
FIG. 5 is a close-up view of a variable portion of the reel strip according to an exemplary embodiment.

Referring to FIG. 5, the variable portion 212 of the first symbol 206 is shown according to an exemplary embodiment. In FIG. 5, both the first image 220 and the second image 222 are shown within the variable portion 212. In an exemplary embodiment, the images 220 and 222 are printed onto the reel strip 200 using two different colors. In this embodiment, the first image 220 may be printed using a first ink having a first color and the second image 222 may be printed using a second ink having a second color that is distinct from the first color. In areas of the variable portion 212 where the first image 220 and the second image 222 overlap (e.g., where the star 226 and/or the stripes 228 overlap with the text 232), the overlapping portions are printed using a third ink having a third color. The third color is substantially clear or white in exemplary embodiments. In an exemplary embodiment, the second ink suppresses or filters light having the first light configuration, such that light having the first light configuration passes through only the first ink and the third ink to generate the first image 220 (i.e., cause the first image 220 to be viewable by a user of the gaming device 100). In this embodiment, the first ink suppresses or filters light having the second light configuration, such that light having the second light configuration passes through only the second ink and the third ink to generate the second image 222 (i.e., cause the second image 222 to be viewable by a user of the gaming device 100). When the light source 150 backlights the reel strip 200 with a light having another configuration (i.e., not the first or the second light configuration), both the first image 220 and the second image 222 may be viewable as in FIG. 5. In an exemplary embodiment, the first image 220 and the second image 222 are alternately viewable within the same variable portion 212 (e.g., symbol, area, space, etc.) when the reel strip 200 is backlit by an LED light having a specified light configuration (e.g., a color, an intensity, a brightness, a luminosity, a color pattern, a light pattern, a spectrum, etc.). In an exemplary embodiment, the first image 220 and the second image 222 overlap at one or more portions, sharing at least some area within the variable portion 212.

The variable portion 212 of the first symbol 206 may be utilized to convey one or more conditions of the gaming device 100, such as to indicate a change between two or more gaming modes of the gaming device 100 or to indicate two different game outcomes. In one embodiment, a particular symbol combination including the first symbol 206 may have a different value (e.g., prize value, cash value, etc.) depending on whether the first image 220 or the second image 222 is displayed (i.e., viewable). The value of the symbol combination may then be changeable by changing the light configuration of the light source 150 to display image 220 or image 222. For instance, a symbol combination including the first symbol 206 may be a winning combination or have a higher value when the first image 220 is viewable, and may be a losing combination or have a lower value when the second image 222 is viewable. The controller 600 may be configured to selectively modulate the light source 150 between the first light configuration and the second light configuration in order to display the first image 220 or the second image 222, respectively. By modulating between the first and second light configurations, the controller 600 may be able to change the value of a particular symbol combination based on the image displayed, and thus increase the number of possible symbol combinations within the game.

In one embodiment, an image of the symbol 206 may be changeable after one or more of the reels 140 have stopped spinning, such as to produce a visual effect. In this embodiment, the controller 600 may be configured to modulate the light source 150 between two or more light configurations after one or more of the reels 140 have stopped spinning in order to change the image displayed within symbol 206. The value of a particular symbol combination may be independent of the particular image displayed within symbol 206. For instance, the images that are displayable within the variable portion 212 may be variations of the same shape or design, with each of the images having the same value within a game. The controller 600 may be configured to modulate the light source 150 between two or more light configurations depending on a particular set of conditions. As an example, the controller 600 may also be configured to toggle between the two or more light configurations when the game has been idle for a predetermined period of time, such as to attract a player to the gaming device 100.

In another embodiment, the image of the symbol 206 may be changeable as the reel 140 is spinning to produce a visual effect. In this embodiment, the controller 600 may be configured to modulate the light source 150 between two or more light configurations as the reels 140 are spinning in order to display two or more separate images within the symbol 206. The visual effect may be intended to attract players to the game or to increase enjoyment of the game. The varied images may relate to different values within a particular symbol combination, or the images may be solely for visual effect. The controller 600 may be configured to modulate the light source 150 depending on one or more conditions of the gaming device 100, including a game type or game mode, a time of day, a running game time for a particular player, and the like.

In another embodiment, the image within a symbol (e.g., symbol 206) may be varied (i.e., the first or second light configuration may be varied) after the reel 140 has stopped if a predetermined symbol (e.g., symbol 206) is displayed (e.g., is in the display position) and/or if a predetermined symbol combination is displayed. For instance, the predetermined symbol combination may be associated with a bonus mode or another outcome of the game. If the predetermined symbol combination is displayed, the controller 600 may be configured to automatically modulate the light source 150 to display a selected image in order to indicate the bonus mode has been activated or another similar outcome. In one embodiment, a first image within a particular symbol may be associated with a default or base mode of a particular game and a second image may periodically be "unlocked," or made viewable (i.e., the light configuration may be changed), in order to indicate another mode of the game. For instance, the second image may indicate the start of a bonus round, receipt of a free spin, or the like. The controller 600 may also be configured to modulate the light source 150 to change an image based on one or more conditions of the gaming device 100, the gaming environment (e.g., casino), the game being played, and/or based on the particular player. For instance, the light source 150 may be modulated to produce a visual effect in order to indicate a particular outcome (e.g., a winning game play, an achieved bonus or unlocked bonus mode, a jackpot, etc.).

The light sources 150 of adjacent reel assemblies 118 may be controlled (e.g., modulated, varied, changed, etc.) separately or in unison. In one embodiment, the controller 600 is configured to modulate the light sources to project a substantially identical light configuration through each of the reels 140 of the gaming device 100, regardless of any other conditions of the gaming device 100. In another embodiment, the light sources 150 may be controlled in groups based on a condition. For instance, the light sources 150 may be configured to project a first light configuration when an associated reel 140 is spinning, but project a second light configuration when the reel 140 stops spinning. The first light configuration may be configured to hide or disguise an image within a symbol, and the second light configuration may be configured to reveal the intended image. In another embodiment, each of the light sources 150 is controlled independently by controller 600.

In another embodiment, each reel strip 200 includes a second set of symbols in addition to the first set of symbols 202. The second set of symbols are positioned between each of the first set of symbols 202 (e.g., within the "white space" of the strip 200) and include a variable portion configured to toggle between two or more images in response to light backlighting the reel strip 200 from the light source 150 and having a specific light configuration. The second set of symbols may appear as white space in response to a first light configuration and be revealed or displayed in response to a second light configuration. For instance, the symbol may be revealed in order to convert a losing symbol combination into a winning symbol combination, such as when the second set of symbols lands on a pay line. In this embodiment, the light configuration may be changed after the reels 140 have stopped in order to reveal or change the second set of symbols.

In another embodiment, the controller 600 may be configured to control the light source 150 based on a user or player of the gaming device 100. In this embodiment, a player may be identified based on a loyalty card received at the loyalty card acceptor 112. The controller 600 may be configured to control the light source 150 and change one or more symbols of the reel strip 200 based on data from the loyalty card related to the player. For instance, the symbol 206 may be changeable to display an image indicating special offers to a particular player, such as meals, hotel accommodations, drink specials, and the like. The symbol 206 may also be changeable to indicate a bonus round or unique game mode based on a number of game plays for a particular player. The symbol 206 may also be changeable based on particular preferences of a given player, such as to reveal unique characters or symbols chosen by the player. In other embodiments, the symbols and/or images of the reel strip 200 may be otherwise tailored to a particular player based on player data.

Figure 6:
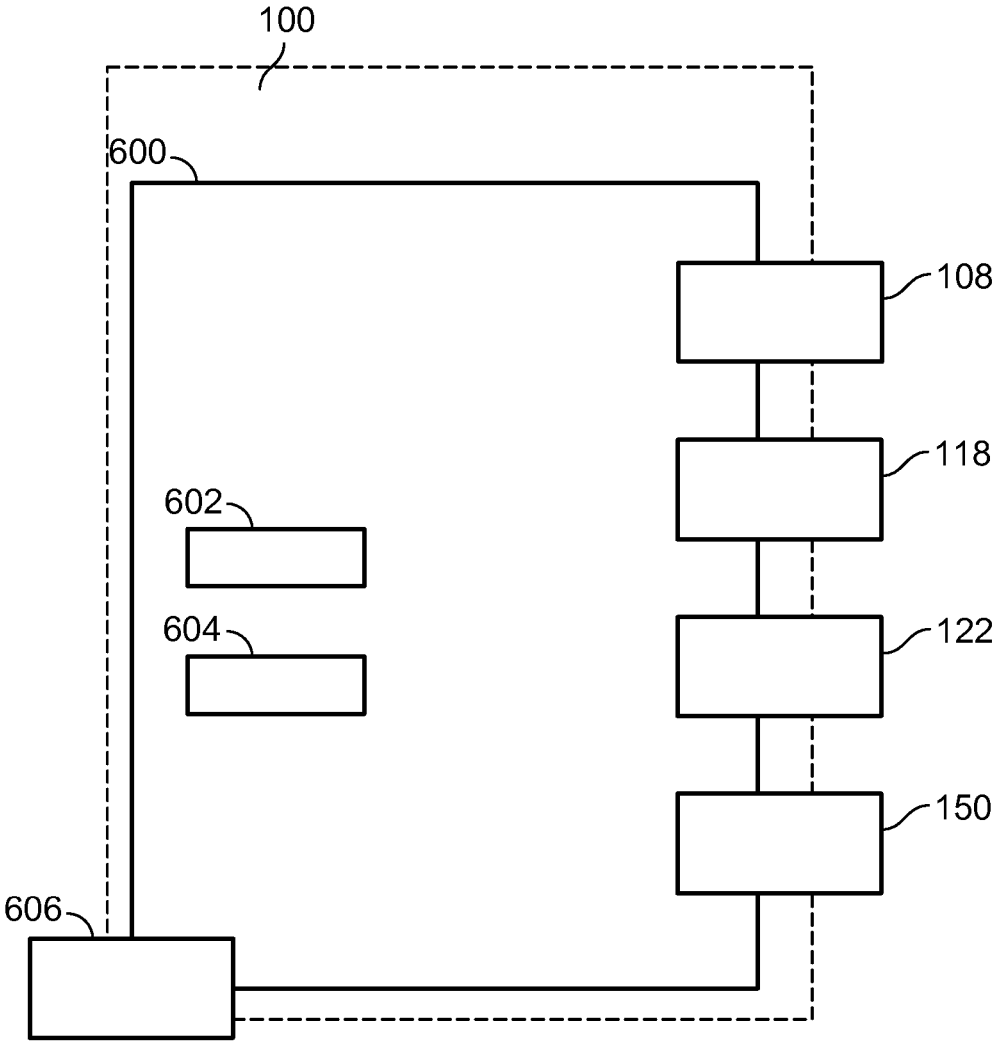
FIG. 6 is a block diagram of a controller for the gaming device according to an exemplary embodiment.

Referring now to FIG. 6, a block diagram of a game controller 600 is shown according to one embodiment. The game controller 600 may be used to control one or more components of the gaming device 100, to store inputs or other information related to the gaming device 100, as well as to perform any functions or processes of the gaming device 100. In the illustrated embodiment of FIG. 6, the game controller 600 is shown coupled to the gaming device 100. However, in other embodiments, the game controller 600 may be independent of the gaming device 100. For instance, the game controller 600 may be stored at a secure location and configured to communicate with the gaming device 100 remotely.

In the illustrated embodiment of FIG. 6, the game controller 600 includes a processor 602 and a memory device shown as memory 604. In this embodiment, the memory 604 stores programming instructions that, when executed by the processor 602, control the operations of the gaming device 100, including the revolution of the slot reel 140 (e.g., via communication with the slot reel assemblies 118) and the projection of light from the light source 150. In other embodiments, the memory 604 and the processor 602 may be used to control other components of the gaming device 100, as well as to execute any functions or processes of the gaming device 100 described above. As shown in FIG. 6, the game controller 600 may be in electrical communication with the inputs 108, the slot reel assemblies 118, the electronic display 122, the light source 150, and any other components of the gaming device 100, such as by a physical wire or by a remote (e.g., wireless) connection, as may be suitable for the particular application of the game controller 600. For instance, the gaming device 100 may include other inputs or outputs (e.g., the printer 110, the slot reel handle 114, etc.) for communicating with the user of the gaming device 100 in other embodiments. In such arrangements, the game controller 600 is in electrical communication with each of the components of the gaming device 100.

In an exemplary embodiment, the game controller 600 is configured to communicate with the light source 150 and programmed to control the light source 150 in order to execute one or more functions or game modes of the gaming device 100. For instance, the game controller 600 may be programmed to command the light source 150 to emit light having the first light configuration when the light source 150 is in a first mode, which may also be when the gaming device 100 is in a first game play mode (e.g., by sending an electronic signal). In an exemplary embodiment, the game controller 600 sends the command to the light source 150 when the first symbol 206 is in a viewing position on the slot reel 140. In this embodiment, the game controller 600 may be programmed to send the command to the light source 150 in response to a signal received from the inputs 108 or based on other information received from a component of the gaming device 100. The first mode may be the default mode for the light source 150, such that the light source 150 is configured to emit light having the first light configuration as a default command. The game controller 600 may also be programmed to command the light source 150 to emit light having the second light configuration when the light source 150 is in the second mode, which may also be when the gaming device 100 is in a second game play mode. In some embodiments, the second mode is an auxiliary or bonus mode, and the second image 222 within the first symbol 206 includes a bonus or wild card designation. However, in other embodiments, the second mode is utilized within a default or main game play mode of the gaming device 100. In an exemplary embodiment, the game controller 600 is programmed to store or record any commands or signals sent or received, such as any information related to the functions or processes of the gaming device 100, within the memory 604 to be available for upload. The stored information may be uploaded from the memory 604 upon request, or by a schedule.

The game controller 600 receives operational electrical power from a power supply 606. In one embodiment, the power supply 606 provides power to the game controller 600 and all components of the gaming device 100, including the light source 150 and the slot reel assemblies 118. The power supply 606 may also supply power to other components of the gaming device 100, or other components or devices that are connected to or in communication with the gaming device 100. The power supply 606 may be any suitable power source, including, but not limited to, a battery, a generator, a solar power source, grid power, or a combination thereof. In arrangements where power supply 606 includes a rechargeable battery, the battery may be charged during operation through another power source (e.g., a generator, a solar panel, grid power, etc.).

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal, e.g., a machine-generated electrical, optical, or electromagnetic signal, that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

It should further be noted that for purposes of this disclosure, the term "couple" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or, alternatively, may be removable or releasable in nature.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

What is claimed is:

1. A gaming device comprising:

a cabinet;

a display coupled to the cabinet;

a reel assembly positioned within the cabinet, the reel assembly comprising:

a reel configured to rotate; and a reel strip coupled to the reel and comprising:

a first static portion having a first static shape; and a symbol configured to be evaluated for winning symbol combinations, said symbol positioned within the first static portion, said symbol having a first border, said symbol having a variable portion, said variable portion defined within a second border, said first border being different than said second border, and said variable portion including a first image in a defined area of the variable portion and a second different image in the same defined area of the same variable portion and overlapping the first image, said symbol having a second static image within the first border and outside the second border;

a light source located within the cabinet and configured to selectively project a light for backlighting the reel strip, wherein the light source has a first mode for projecting the light in a first configuration to the variable portion and a second mode for projecting the light in a second different configuration to the variable portion; and a game controller coupled to the cabinet and configured to control the light source;

wherein the first image is viewable in the defined area of the variable portion when the light source projects the light in the first configuration to backlight the variable portion, and wherein the second different image is alternatively viewable in the same defined area of the same variable portion when the light source projects the light in the second different configuration to backlight the variable portion.

2. The gaming device of claim 1, wherein the first image and the second different image are alternately viewable when the reel is stationary.

3. The gaming device of claim 1, which includes a display position viewable by a user of the gaming device through the display, and wherein the reel is configured to rotate such that the symbol is in the display position.

4. The gaming device of claim 3, wherein the game controller is programmed to prevent the light source from projecting the light until the symbol is in the display position.

5. The gaming device of claim 1, wherein the first light configuration includes a first color and the second different light configuration includes a second different color.

6. The gaming device of claim 5, wherein the first image includes a first portion tinted by the first color, and wherein the second different image includes a second portion tinted by the second different color.

7. The gaming device of claim 1, wherein the first image and the second different image are printed on the reel strip in a single layer of film.

8. The gaming device of claim 1, wherein the light source is positioned within the reel strip.

9. The gaming device of claim 1, wherein the variable portion maintains a static shape in response to a second light source projecting a second light at a front side of the reel strip.

10. A reel assembly for a gaming device, the reel assembly comprising:

a chassis;

a reel coupled to the chassis and configured to rotate relative to the chassis;

a reel strip coupled to the reel and configured to rotate with the reel, the reel strip comprising a first static portion having a static shape and a symbol configured to be evaluated for winning symbol combinations, said symbol positioned within the first static portion, said symbol having a variable portion, said variable portion defined within a second border, said first border being different than said second border, and said variable portion including a first image in a defined area of the variable portion and a second different image in the same defined area of the same variable portion and overlapping the first image, said symbol having a second static image within the first border and outside the second border; and a light source coupled to the chassis and positioned within the reel strip to backlight the reel strip, wherein the light source has a first mode for projecting the light in a first configuration to the variable portion and a second mode for projecting the light in a second different configuration to the variable portion;

wherein the first image is viewable in the defined area of the variable portion when the light source projects the light in the first configuration to backlight the variable portion, and wherein the second different image is alternatively viewable in the same defined area of the same variable portion when the light source projects the light in the second different configuration to backlight variable portion.

11. The reel assembly of claim 10, which includes a display position viewable by a user of the gaming device, and wherein the reel is configured to rotate such that the symbol is in the display position.

12. The reel assembly of claim 11, wherein the light source is configured to project the light only when the symbol is in the display position.

13. The reel assembly of claim 10, wherein the first light configuration includes a first color and the second different light configuration includes a second different color.

14. The reel assembly of claim 13, wherein the first image includes a first portion tinted by the first color, and wherein the second different image includes a second portion tinted by the second different color.

15. The reel assembly of claim 10, wherein the first image and the second different image are printed on the reel strip in a single layer of film.

16. The reel assembly of claim 10, wherein the variable portion maintains a static shape in response to a second light source projecting a second light at a front side of the reel strip.

17. The reel assembly of claim 10, wherein the first image and the second different image are alternately viewable in the variable portion when the reel is stationary.

18. A reel strip for a mechanical reel gaming device, the reel strip comprising:

a flexible laminate for attaching to a slot reel;

a static portion having a static shape; and a symbol positioned on the flexible laminate and configured to be evaluated for winning symbol combinations, said symbol positioned within the first static portion, said symbol having a first border, said first having a variable portion, said variable portion defined within a second border, said first border being different than said second border, and said variable portion including a first image in a defined area of the variable portion and a second different image in the same defined area of the same variable portion and overlapping the first image, said symbol having a second static image within the first border and outside the second border;

wherein the first image is viewable in the defined area of the variable portion in response to a light source projecting a light having a first light configuration to backlight the variable portion, and wherein the second different image is alternatively viewable in the same defined area of the same variable portion in response to the light source projecting a light having a second different light configuration to backlight the variable portion.

19. The reel strip of claim 18, wherein the variable portion maintains a static shape in response to a second light source projecting a second light at a front side of the reel strip.

20. The reel strip of claim 18, wherein the first image and the second different image are printed on the flexible laminate in a single layer of film.

21. The reel strip of claim 18, wherein the first image has a different shape than the second image.

22. The reel strip of claim 18, further comprising a substantially transparent border surrounding the symbol, wherein the substantially transparent border is configured to convey a color of the first light configuration or the second different light configuration.

* * * * *